United States Patent [19]

Bonaguidi

[11] 4,272,936

[45] Jun. 16, 1981

[54] INVERTED ROOF SYSTEM

[76] Inventor: Orland H. Bonaguidi, 1363 Cottontail La., La Jolla, Calif. 92037

[21] Appl. No.: 332

[22] Filed: Jan. 2, 1979

[51] Int. Cl.[3] ..... E04B 5/00

[52] U.S. Cl. ..... 52/309.12; 52/309.17; 52/408; 52/445

[58] Field of Search ..... 52/408, 409, 410, 411, 52/413, 445, 446, 453; 260/29.6 S, 42.13

[56] References Cited

U.S. PATENT DOCUMENTS

| | | | |
|---|---|---|---|
| 1,239,074 | 9/1917 | Bagnall | 52/408 |
| 3,256,229 | 6/1966 | Tanota | 260/29.6 S |
| 3,411,256 | 11/1968 | Best | 52/408 |
| 3,763,614 | 10/1973 | Hyde | 52/408 |
| 3,892,899 | 7/1975 | Klein | 52/408 |
| 3,895,956 | 7/1975 | Yoshida | 260/29.6 S |
| 4,045,922 | 9/1977 | Elliot | 52/408 |
| 4,077,177 | 3/1978 | Boothroyd | 52/2 |

FOREIGN PATENT DOCUMENTS

| | | | |
|---|---|---|---|
| 753715 | 1/1971 | Belgium | 52/408 |

*Primary Examiner*—James A. Leppink
*Assistant Examiner*—Henry E. Raduazo
*Attorney, Agent, or Firm*—Bruno J. Verbeck; Michael L. Slonecker

[57] ABSTRACT

A roof structure wherein a water impermeable membrane is fabricated upon a roof deck and a thermal insulation layer affixed upon the membrane. The insulation layer is thereafter coated with a suitable adhesive material and particles of inorganic particulate attached thereto, whereby a toothing surface is formed upon which is applied a mortar based insulative-protective layer.

5 Claims, 1 Drawing Figure

INVERTED ROOF SYSTEM

BACKGROUND OF THE INVENTION

The present invention relates to a new and unique variation of, and improvement over, conventional inverted roof structures. As a result of the practice of this invention, an inverted roof structure can be constructed which possesses superior fire-retardant, protective, and insulative properties, while concurrently significantly reducing the overall weight of the composite roof structure. It is an important feature of this invention that such improved structure can be constructed independent of the pitch angle the roof structure forms with the horizontal.

The method and structure of inverted roof systems is well known and practiced by members of the building profession. For example, U.S. Pat. No. 3,411,256, held by the Dow Chemical Company, (hereinafter "Dow"), discloses an inverted roof structure, and method thereof, which comprises a roof deck, water impermeable membrane, closed cell water impermeable thermal insulating member, and a water permeable protective layer. This structure reduces exposure of the water impermeable membrane to adverse environmental conditions, thereby protecting the membrane and extending the useful life of the roof structure.

While the structure taught by Dow is now used throughout the building industry, the structure possesses several significant limitations which renders it generally unsuitable for use under many naturally existing conditions. For example, inasmuch as the protective layer is water permeable, moisture passing therethrough ultimately contacts the underlying water impermeable membrane and can cause cracking of said membrane due to cyclical freezing and thawing conditions. Further Dow recognizes that the thermal insulation member is subject to decomposition, particularly when exposed to sunlight; however it fails to disclose a method by which the insulating member may be permanently protected from such elements. Still further, a roof structure constructed in accordance with the Dow disclosure utilizing styrene for the thermal insulation member requires approximately 1200 pounds of gravel per 100 square feet of roof surface area in order to receive an Underwriter's Laboratories Class R rating for fire retardancy. Finally, Dow fails to disclose a method by which the protective layer can be applied regardless of pitch angle, and, by necessity, structures constructed in accordance with the method of the invention are limited to low pitch angles.

Therefore, it is an object of the present invention to provide a roof structure which substantially inhibits the absorption of water which may adversely effect the water impermeable membrane.

Yet another object is to provide a protective layer which effectively inhibits deterioration of the underlying thermal insulation layer due to foot traffic and adverse environmental conditions.

A still further object is to provide a roof structure which may be constructed without roof pitch angle limitations.

And yet another object is to provide a roof structure characterized by superior insulative and fire retardant qualities while simultaneously achieving an overall reduction in the weight of the structure.

SUMMARY OF THE INVENTION

The present invention relates to a roof structure characterized by a thermal insulation layer secured to the exposed surface of a water impermeable roofing membrane. Adhesive material is thereafter applied to the exposed insulation layer surface and inorganic particles attached thereto in sufficient quantity to ensure that each particle contacts all other contiguous particles. The combination of adhesive and particulate forms what is known as a toothing surface, said surface serving as a means by which a final overlayment of inorganic mortar based compound may be secured to the roof structure. The final overlayment forms a protective skin which serves to retard water absorption through the roof structure, protect the substrate from injury due to foot traffic, ultra-violet light and adverse weather conditions, and increase the insulative "R" factor of the composite structure. It is a unique feature of the present invention that the incorporation of the toothing surface therein permits the application of the final overlayment at any roof pitch angle from horizontal.

DESCRIPTION OF THE PREFERRED EMBODIMENT

Figure 1:
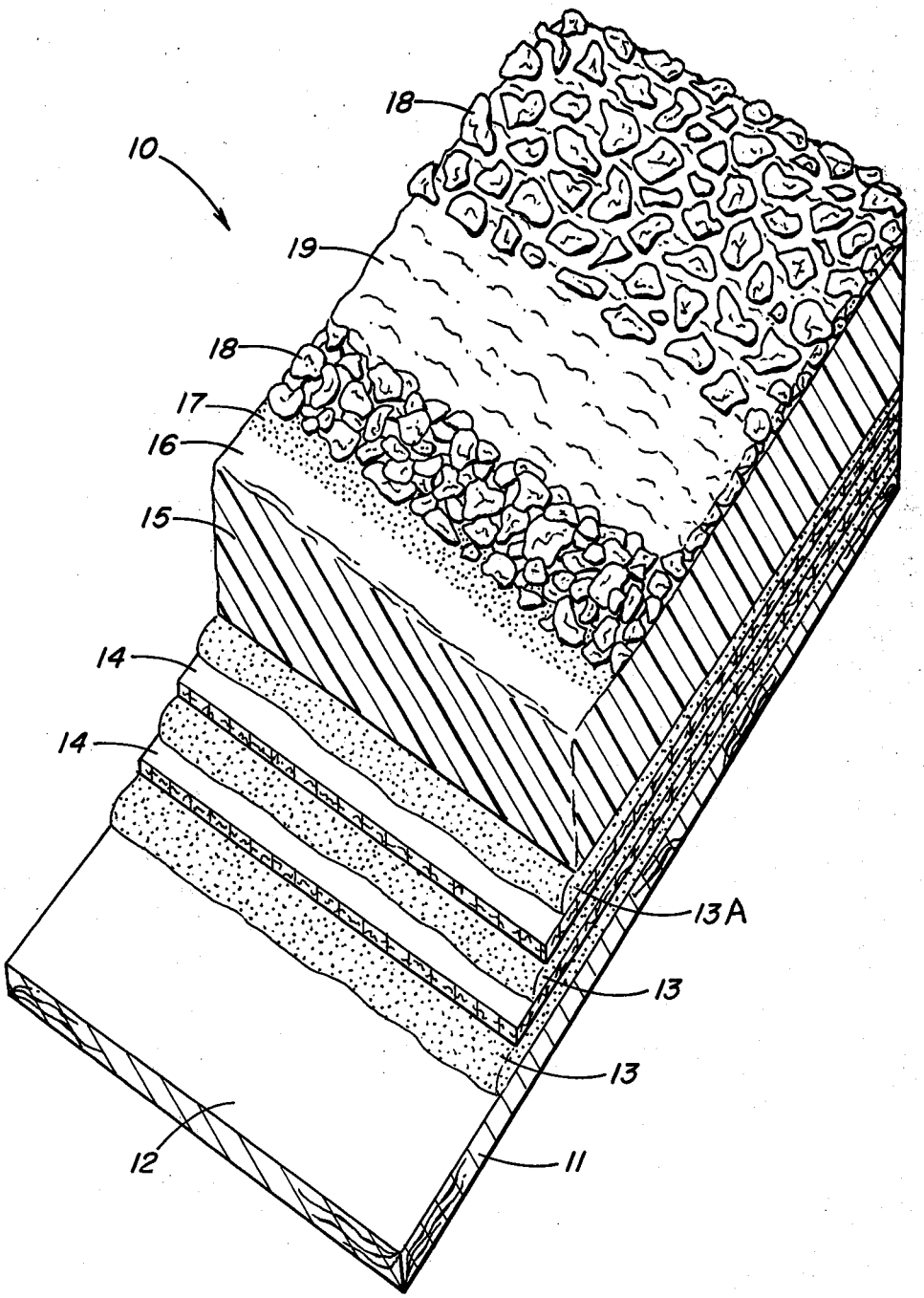
FIG. 1 is a perspective view of the preferred embodiment illustrating the multiplicity of layers and materials which comprise my inverted roof system.

For a more complete understanding of my invention, reference may be made to FIG. 1 which illustrates an inverted roof system 10 constructed in accordance with the practice of the present disclosure. The inverted roof system 10 comprises a roof deck 11 secured upon a multiplicity of rafters or other suitable roof support structure (not shown), said roof deck 11 having an exposed outer surface 12. A water impermeable membrane, comprising a plurality of alternating layers of adhesive 13, roofing felt 14, and a final overlayment of adhesive-sealant coat 13A is thereafter secured to the roof deck 11 such that the exposed outer surface 12 of roof deck 11 is completely covered by the water impermeable membrane. Secured upon adhesive-sealant coat 13A, the outermost layer of the membrane, is a thermal insulation layer 15 having an upper surface 16. A toothing surface is formed upon the thermal insulation layer 15 by coating the upper surface 16 of layer 15 with an adhesive 17, and thereafter partially imbedding a singular layer of inorganic particles 18 into adhesive 17. The particles 18 are applied in sufficient quantity so as to ensure that the entire exposed surface of adhesive 17 is uniformly covered with the particles 18, each particle in continuous contact with contiguous particles. Finally, a mortar based insulative-protective layer 19 is applied onto the toothing surface, thereby completing the composite structure. If aesthetically desired, additional particles 18 may be partially imbedded into layer 19 prior to its solidification.

The roof support structure, the roof deck, water impermeable membrane, and thermal insulation layer may be constructed from a wide variety of materials well known to practitioners in the building industry. For example, the water impermeable membrane may be fashioned by overlapping alternating layers of asphaltic base adhesive and roofing felt in sufficient quantity to ensure water impermeable integrity, two or three layers of each usually considered as being satisfactory.

Selection of the proper sealant-adhesive coat to be overlayed upon the water impermeable membrane depends upon the practitioner's choice of material used to form the thermal insulation layer. Beneficially, such insulation layer would be comprised of closed cell plastic foam material such as polyurethane foams, styrene polymer foams, and others well known to the art.

Inasmuch as polyurethane foams and the like are characterized by a high degree of resistance to degredation and distortion when contacted with high temperature adhesive materials such as hot asphalt, either hot process or cold process adhesives may be utilized to seal the membrane and secure the thermal insulation layer thereon.

Styrene, however, is particularly susceptible to distortion and degredation when contacted with high temperature adhesive materials; therefore, the use of a cold process, water based acrylic resin or asphaltic emulsion for the sealant-adhesive coat is desirable in order to secure the styrene material upon the underlying substrate. Adhesives such as those manufactured by Thermo Materials, Incorporated of San Diego, Calif. under the names Thermo Concentrate #101A (thermo plastic acrylic polymer) and Thermo Series 200 E (asphaltic emulsion) have proven suitable for use in bonding the styrene to the membrane.

These aforementioned limitations similarly apply to the selection of the adhesive incorporated into the toothing surface. If styrene, or other similar thermo plastic synthetic resinous material is used to form the thermal insulation layer, the adhesive must be ameanable to cold process application. Alternatively, hot asphalt may be utilized as an adhesive if interposed between the styrene and the adhesive is a protective layer of saturated asphaltic felts or the like which serve to inhibit styrene degredation.

While the adhesive utilized in the toothing surface is in a plastified state, $+\frac{1}{4}$ inch, $-\frac{3}{8}$ inch gravel, applied at the rate of approximately 150 pounds gravel per 100 square feet of adhesive surface area, is partially imbedded therein in sufficient quantity to ensure contiguous particle contact over the entire adhesive surface. Where the possibility of water ponding and continuous cyclical freeze/thaw conditions are likely to occur, gravel size must be increased to $+\frac{1}{4}$ inch, $-\frac{3}{8}$ inch.

When the roof structure has been thus far completed, the final construction step consists of the preparation and application of the insulative-protective layer. Basically, the layer is comprised of an inorganic mortar based compound made up of the following ingredients in substantially the proportions stated:

| | |
|---|---|
| White cement | 51% |
| Magnesium silica or calcium carbonate flour | 38.5% |
| Perlite fines; +200, −300 mesh | 1.5% |
| Clay; +200, −300 mesh | 3.0% |
| Lime; +200, −300 mesh | 5.5% |
| Thickener | 0.2% |

The above mixture of dry powder is thereafter added in a continuous stream at the rate of 50 pounds powder to six gallons of water and agitated to ensure homogenity. Finally, an additional one-half gallon of vinyl acrylic polymer or acrylic emulsion vehicle is added and uniformly dispersed throughout the mixture prior to ceasing agitation. The latter ingredient serves the purpose of increasing the compressive strength of the protective-insulative layer, and retards water absorption through the layer.

The ingredients disclosed in the above example will yield a white color composition. It should be understood, however, that color variation may be obtained by the addition of pigments or the like. Still further, the above example contemplates application of the mixture under moderate temperature conditions. If application is to be made at temperatures below freezing, five pounds of barium chloride per 50 pounds of dry powder may be added to accelerate prolonged setting associated with low temperature conditions.

The composition thus formed is thereafter uniformly applied with a pressure hose upon the entire toothing surface at a minimum rate of 50 pounds per 100 square feet of surface area. During application, the composition remaining to be used must undergo continuous agitation and any of the mixture not utilized within three hours of mixing must be discarded.

It is thus seen that upon solidification of the insulative-protective layer, a structure is formed possessing superior insulative, protective, and fire-retardant qualities over present state of the art structures. Further, by incorporating a toothing surface into the composite structure, a surface is formed whereby the insulative-protective layer may be secured to the roof structure without restriction due to the roof pitch angle.

It is understood that the above description of my invention is done to fully comply with the requirements of 35 USC 112 and not intended to limit my invention in any way. It can be seen that variant forms of my invention could easily be developed by practitioners skilled in the art. For example, the toothing surface could be eliminated from the composite structure whenever the roof pitch angle is substantially 0°. Inasmuch as this and many other variant forms of my invention are possible, such variant forms are considered to be within the scope and essence of my invention.

What is claimed is:

1. An inverted roof structure of reduced weight and enhanced insulative, protective, and fire retardant qualities, which comprises:
   (a) roof support means;
   (b) a roof deck secured to said roof support means;
   (c) a water impermeable membrane affixed to the exposed outer surface of said roof deck;
   (d) a sealant-adhesive coat disposed over said membrane;
   (e) a thermal-insulation layer comprised of closed-cell plastic foam secured to said membrane by means of said sealant-adhesive coat;
   (f) a toothing surface secured upon said thermal-insulation layer; and
   (g) a substantially water-impermeable insulative-protective layer uniformly disposed upon toothing surface in the amount of at least about 50 pounds per 100 square feet of surface area and secured thereto, said insulative-protective layer being formed from an admixture substantially comprising unset white cement, water, perlite fines, finely divided clay and lime, a thickener, a vinyl acrylic polymer, and magnesium silica flour.

2. An inverted roof structure as defined in claim 3, wherein said toothing surface comprises an adhesive and particles of inorganic particulate, said particles being partially embedded in said adhesive and being in sufficient quantity to insure continuous and contiguous particle contact over the entire surface of the adhesive.

3. An inverted roof structure of reduced weight and enhanced insulative, protective, and fire retardant qualities, which comprises:

(a) a roof support means;
(b) a roof deck secured to said roof support means;
(c) a water impermeable membrane affixed to the exposed outer surface of said roof deck;
(d) a sealant-adhesive coat disposed over said membrane;
(e) a thermal-insulation layer comprised of closed-cell plastic foam secured to said membrane by means of said sealant-adhesive coat;
(f) a toothing surface secured upon said thermal-insulative layer; and
(g) a substantially water-impermeable insulative-protective layer uniformly disposed upon said toothing surface in the amount of at least 50 pounds per 100 square feet of surface area and secured thereto, said insulative-protective layer being formed from an admixture substantially comprising unset white cement, water, perlite fines, finely divided clay and lime, a thickener, a vinyl acrylic polymer, and calcium carbonate flour.

4. An inverted roof structure of reduced weight and enhanced insulative, protective, and fire retardant qualities, which comprises:

(a) a roof support means;
(b) a roof deck secured to said roof support means;
(c) a water impermeable membrane affixed to the exposed outer surface of said roof deck;
(d) a sealant-adhesive coat disposed over said membrane;
(e) a thermal-insulation layer comprised of closed-cell plastic foam secured to said membrane by means of said sealant-adhesive coat;
(f) a toothing surface secured upon said thermal-insulative layer; and
(g) a substantially water-impermeable insulative-protective layer uniformly disposed upon said toothing surface in the amount of at least about 50 pounds per 100 square feet of surface area and secured thereto, said insulative-protective layer being formed from an admixture substantially comprising unset white cement, water, perlite fines, finely divided clay and lime, a thickener, an acrylic emulsion, and magnesium silica flour.

5. An inverted roof structure of reduced weight and enhanced insulative, protective, and fire retardant qualities, which comprises:

(a) roof support means;
(b) a roof deck secured to said roof support means;
(c) a water impermeable membrane affixed to the exposed outer surface of said roof deck;
(d) a sealant-adhesive coat disposed over said membrane;
(e) a thermal-insulation layer comprised of closed-cell plastic foam secured to said membrane by means of said sealant-adhesive coat;
(f) a toothing surface secured upon said thermal-insulative layer; and
(g) a substantially water-impermeable insulative-protective layer uniformly disposed upon said toothing surface in the amount of at least about 50 pounds per 100 square feet of surface area and secured thereto, said insulative-protective layer being formed from an admixture substantially comprising unset white cement, water, perlite fines, finely divided clay and lime, a thickner, an acrylic emulsion vehicle, and calcium carbonate flour.

* * * * *